US009659687B2

(12) United States Patent
Nakatani et al.

(10) Patent No.: US 9,659,687 B2
(45) Date of Patent: May 23, 2017

(54) NOISE REDUCTION CABLE

(71) Applicant: Hitachi Metals, Ltd., Tokyo (JP)

(72) Inventors: Katsutoshi Nakatani, Hitachi (JP); Yosuke Sumi, Hitachi (JP); Katsuya Akimoto, Hitachi (JP); Kenji Ajima, Hitachi (JP); Hiroshi Okikawa, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/094,839

(22) Filed: Apr. 8, 2016

(65) Prior Publication Data

US 2016/0314875 A1 Oct. 27, 2016

(30) Foreign Application Priority Data

Apr. 23, 2015 (JP) ..... 2015-088716

(51) Int. Cl.
*H01B 11/10* (2006.01)

(52) U.S. Cl.
CPC ..... *H01B 11/1091* (2013.01); *H01B 11/1041* (2013.01); *H01B 11/1083* (2013.01)

(58) Field of Classification Search
USPC ..... 174/360, 391
See application file for complete search history.

(56) References Cited

U.S. PATENT DOCUMENTS

| | | | | |
|---|---|---|---|---|
| 4,510,346 | A * | 4/1985 | Bursh, Jr. | H01B 11/1016 174/106 R |
| 5,262,591 | A * | 11/1993 | Aldissi | C08K 3/24 174/106 SC |
| 7,091,423 | B2 * | 8/2006 | Yumura | H01B 12/06 174/125.1 |
| 7,342,172 | B1 * | 3/2008 | Wang | H01B 11/1083 174/36 |
| 2001/0030121 | A1 * | 10/2001 | Ono | H01B 11/1083 204/192.1 |
| 2004/0055772 | A1 * | 3/2004 | Tsutsui | H01B 11/1025 174/36 |
| 2015/0228377 | A1 * | 8/2015 | Akimoto | H01B 11/1083 174/36 |

FOREIGN PATENT DOCUMENTS

JP H 06-203652 A 7/1994

* cited by examiner

*Primary Examiner* — William H Mayo, III
*Assistant Examiner* — Krystal Robinson
(74) *Attorney, Agent, or Firm* — McGinn IP Law Group, PLLC

(57) ABSTRACT

A noise reduction cable includes an insulated wire including an insulator and a wire conductor, an outer circumference of which is coated with the insulator, a magnetic-material layer including a magnetic-material-containing member wound around an outer circumference of the insulated wire, a shield layer with which an outer circumference of the magnetic-material layer is coated, a magnetic-material-fixing-and-insulating tape layer that is disposed between the magnetic-material layer and the shield layer. The magnetic-material-fixing-and-insulating tape layer fixes the magnetic-material layer and insulates the magnetic-material layer and the shield layer from each other.

14 Claims, 2 Drawing Sheets

NOISE REDUCTION CABLE

The present application is based on Japanese patent application No. 2015-088716 filed on Apr. 23, 2015, the entire contents of which are incorporated herein by reference.

BACKGROUND OF THE INVENTION

1. Field of the Invention

The present invention relates to a noise reduction cable.

2. Description of the Related Art

In a noise reduction cable known to date, a leak of magnetic flux to the outside is suppressed by winding a tape-like magnetic material around an insulated wire, and radiation noise is thereby reduced (see, for example, Japanese Unexamined Patent Application Publication No. 6-203652).

In the noise reduction cable disclosed in Japanese Unexamined Patent Application Publication No. 6-203652, an amorphous magnetic-material tape is wound around the outer circumference of a shield layer with which the insulated wire is coated. An insulating layer to insulate the shield layer and the amorphous magnetic-material tape from each other is disposed between the shield layer and the amorphous magnetic-material tape.

SUMMARY OF THE INVENTION

A typical noise reduction cable including a magnetic-material tape such as disclosed in Japanese Unexamined Patent Application Publication No. 6-203652 also includes a fixing tape that is wound around the outer circumference of the magnetic-material tape in order to prevent the wound magnetic-material tape from being detached during production of the cable and to improve production yield.

It is an object of the present invention to provide a noise reduction cable including less components than in the case of existing cables while including a shield layer and a wound magnetic-material layer that can be prevented from being detached during production.

In view of the foregoing and other exemplary problems, drawbacks, and disadvantages of the conventional methods and structures, an exemplary feature of the present invention is to provide a noise reduction cable.

[1] A noise reduction cable includes an insulated wire including an insulator and a wire conductor, an outer circumference of which is coated with the insulator, a magnetic-material layer including a magnetic-material-containing member wound around an outer circumference of the insulated wire, a shield layer with which an outer circumference of the magnetic-material layer is coated, and a magnetic-material-fixing-and-insulating tape layer that is disposed between the magnetic-material layer and the shield layer. The magnetic-material-fixing-and-insulating tape layer fixes the magnetic-material layer and insulates the magnetic-material layer and the shield layer from each other.

[2] In the noise reduction cable described in [1], the magnetic-material-containing member may be made of a metallic magnetic material.

[3] In the noise reduction cable described in [1] or [2], the magnetic-material layer may include the magnetic-material-containing member that is helically wound.

[4] In the noise reduction cable described in [1] or [2], the magnetic-material layer may include the magnetic-material-containing member that is wound such that a longitudinal direction of the magnetic-material-containing member is parallel to an axis of the noise reduction cable.

[5] In the noise reduction cable described in [1] or [2], the magnetic-material layer may include a plurality of the magnetic-material-containing members that are arranged at intervals along an axis of the noise reduction cable.

The present invention can provide a noise reduction cable including less components than in the case of existing cables while including a shield layer and a wound magnetic-material layer that can be prevented from being detached during production.

BRIEF DESCRIPTION OF THE DRAWINGS

The foregoing and other exemplary purposes, aspects and advantages will be better understood from the following detailed description of the invention with reference to the drawings, in which.

DESCRIPTION OF THE PREFERRED EMBODIMENTS

Figure 2A:
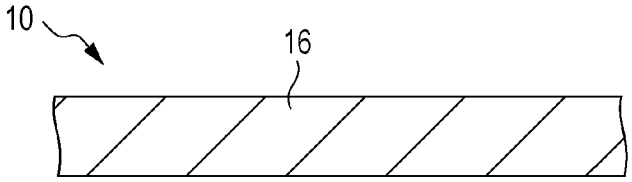
FIG. 2A to FIG. 2C are side views of the noise reduction cable according to the first embodiment of the present invention.
Figure 2B:
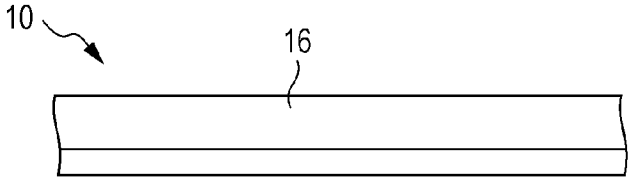
Figure 2C:
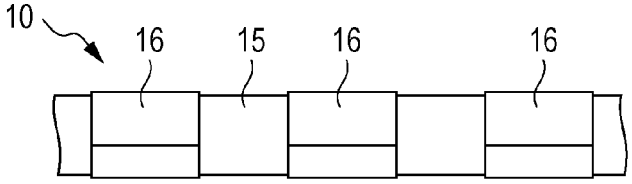
Figure 3:
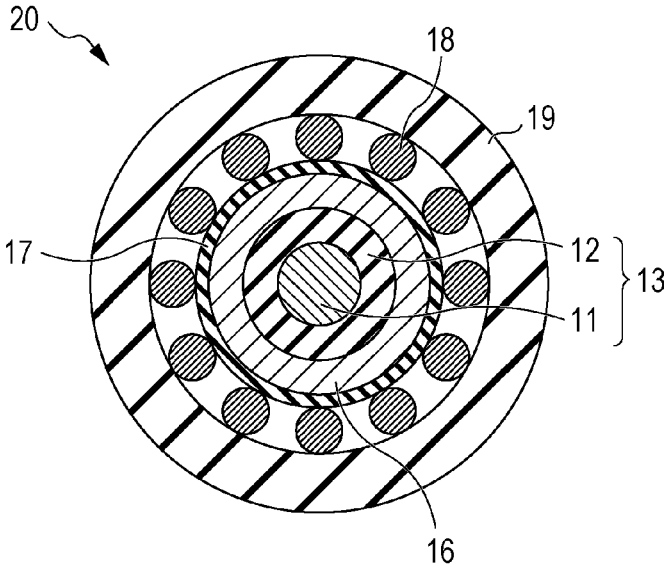
FIG. 3 is a schematic sectional view of a noise reduction cable according to a second embodiment of the present invention.

Referring now to the drawings, and more particularly to FIGS. 1-3, there are shown exemplary embodiments of the structures according to the present invention. In the drawings, like symbols designate components having substantially like functions, and a duplicative description for these components is omitted.

First Embodiment

Figure 1A:
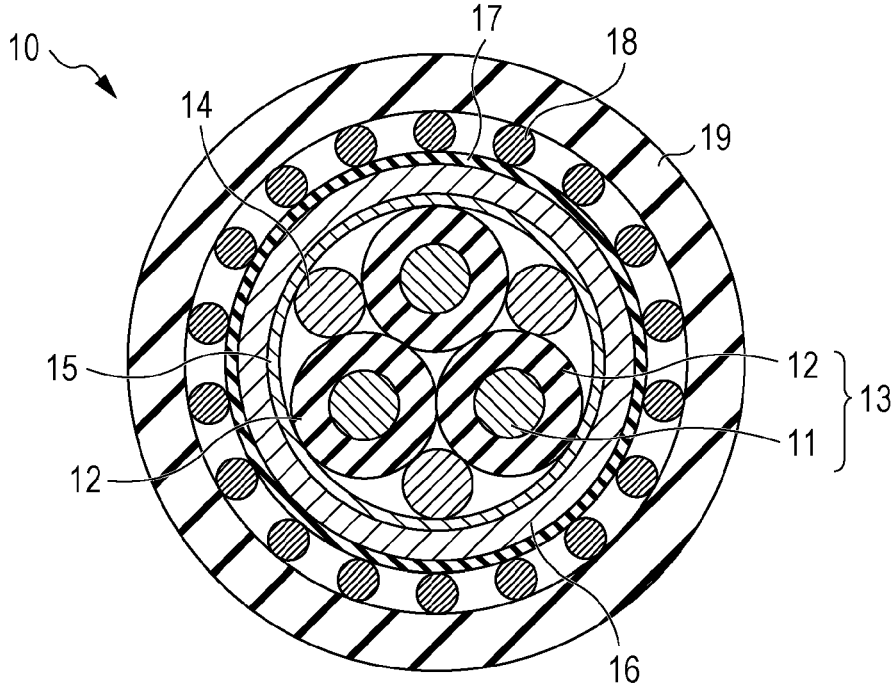
FIG. 1A is a schematic sectional view of a noise reduction cable according to a first embodiment of the present invention.
Figure 1B:
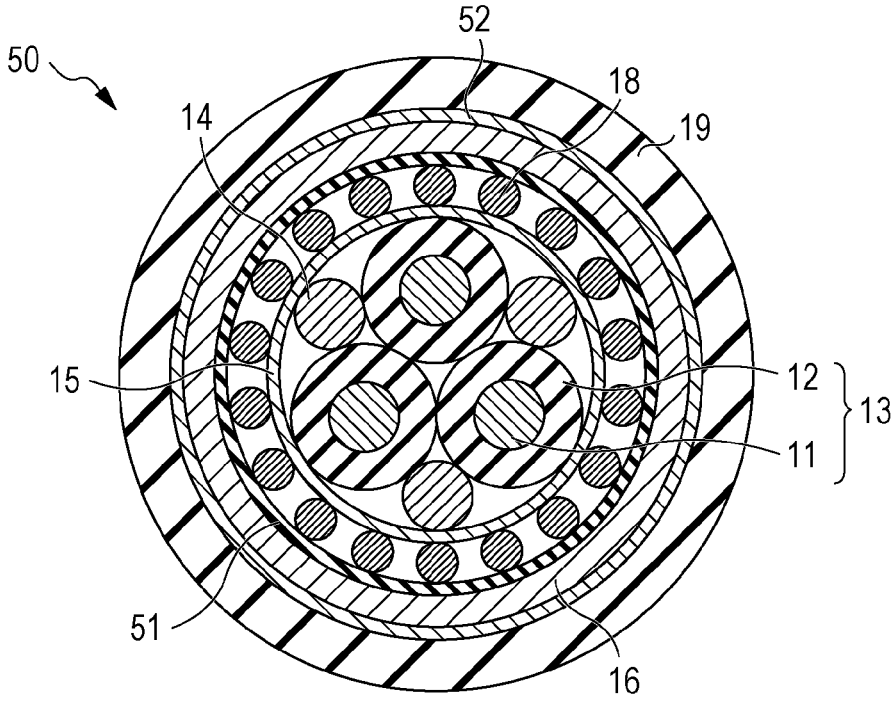
FIG. 1B is a schematic sectional view of a noise reduction cable in a comparative example.

FIG. 1A is a schematic sectional view of a noise reduction cable according to a first embodiment of the present invention. FIG. 1B is a schematic sectional view of a noise reduction cable in a comparative example.

A noise reduction cable 10 according to the first embodiment of the present invention that is shown in FIG. 1A includes a plurality of insulated wires 13 each including an insulator 12 and a wire conductor 11, the outer circumference of which is coated with the insulator 12, a holding layer 15 that is disposed around the insulated wires 13 and holds the insulated wires 13 with interposed objects 14 arranged on the circumferences of the insulated wires 13, a magnetic-material layer 16 including a magnetic-material-containing member that is wound around the outer circumference of the holding layer 15, a shield layer 18 with which the outer circumference of the magnetic-material layer 16 is coated, a magnetic-material-fixing-and-insulating tape layer 17 that is disposed between the magnetic-material layer 16 and the shield layer 18, and a sheath 19 that is an insulating protective layer made of, for example, resin. The magnetic-material-fixing-and-insulating tape layer 17 fixes the magnetic-material layer 16 and insulates the magnetic-material layer 16 and the shield layer 18 from each other.

The insulated wires 13 transfer signals or electric power at, for example, a frequency of 50 Hz to 1 MHz. In an example shown in FIG. 1A, the noise reduction cable 10 is a three-core cable including the three insulated wires 13. However, the number of the insulated wires 13 contained in the noise reduction cable 10 is not limited to three. The noise reduction cable 10 may include a twisted pair wire including two insulated wires 13 that are twisted.

The holding layer 15 is formed of, for example, a holding tape such as a resin tape that is helically wound around the insulated wires 13 and the interposed objects 14 along the axis of the noise reduction cable 10. The holding tape to form the holding layer 15 is made of, for example, resin such as polyethylene terephthalate (PET) resin or polypropylene resin.

The magnetic-material layer 16 suppresses a leak of magnetic flux from the insulated wires 13 and reduces the radiation noise of the noise reduction cable 10. The magnetic-material layer 16 is made of a metallic magnetic material.

A preferable magnetic material contained in the magnetic-material-containing member is a soft magnetic material having low coercivity and high magnetic permeability. Examples of the soft magnetic material may include an amorphous alloy such as a Co-based amorphous alloy or an Fe-based amorphous alloy, ferrite such as Mn—Zn ferrite, Ni—Zn ferrite, or Ni—Zn—Cu ferrite, an Fe—Ni alloy (permalloy), an Fe—Si—Al alloy (sendust), and an Fe—Si alloy (silicon steel).

FIG. 2A to FIG. 2C are side views of the noise reduction cable 10 according to the first embodiment of the present invention. In FIG. 2A to FIG. 2C, components outside the magnetic-material layer 16 are not illustrated.

FIG. 2A is a side view of the noise reduction cable 10 when the magnetic-material layer 16 includes a tape-like magnetic-material-containing member that is helically wound around the outer circumference of the holding layer 15.

FIG. 2B is a side view of the noise reduction cable 10 when the magnetic-material layer 16 includes a sheet-like magnetic-material-containing member that is wound around the outer circumference of the holding layer 15 such that the longitudinal direction of the magnetic-material-containing member is parallel to the axis of the noise reduction cable 10 (in a manner in which a cigarette is rolled).

FIG. 2C is a side view of the noise reduction cable 10 when the magnetic-material layer 16 includes a plurality of magnetic-material-containing members that are arranged at intervals along the axis of the noise reduction cable 10 and wound around the outer circumference of the holding layer 15. In this case, the flexibility of the noise reduction cable 10 can be improved in comparison with the case where the magnetic-material layer 16 is disposed so as to cover the entire outer circumferential surface of the holding layer 15.

The shield layer 18 is formed of, for example, braided strands and connected to ground. The shield layer 18 may be a winding of a tape with a conductor.

The magnetic-material-fixing-and-insulating tape layer 17 is made of an all-purpose tape material such as polyethylene (PE), polyethylene terephthalate (PET), or cellophane, or an insulating tape made of an insulating material such as a heat-resistant tape material. The magnetic-material-fixing-and-insulating tape layer 17 is formed by winding such a material around the outer circumference of the magnetic-material layer 16. The magnetic-material-fixing-and-insulating tape layer 17 can fix the magnetic-material layer 16 and insulate the magnetic-material layer 16 and the shield layer 18 from each other.

With the result that the magnetic-material layer 16 is made of a metallic magnetic material, an electric current readily runs when the magnetic-material layer 16 is in contact with the shield layer 18. Accordingly, the insulation by the magnetic-material-fixing-and-insulating tape layer 17 is important.

A noise reduction cable 50 in a comparative example that is shown in FIG. 1B differs from the noise reduction cable 10 in that the magnetic-material layer 16 is disposed outside the shield layer 18.

With the result that the magnetic-material layer 16 is disposed outside the shield layer 18 in the noise reduction cable 50, the noise reduction cable 50 includes both an insulating tape layer 51 that insulates the magnetic-material layer 16 and the shield layer 18 from each other and a magnetic-material-fixing tape layer 52 that fixes the magnetic-material layer 16, as separated layers.

Second Embodiment

A second embodiment differs from the first embodiment in that the noise reduction cable is a single-core cable. The description of the same features as in the first embodiment is omitted or simplified.

FIG. 3 is a schematic sectional view of a noise reduction cable according to the second embodiment of the present invention.

A noise reduction cable 20 according to the second embodiment of the present invention that is shown in FIG. 3 includes an insulated wire 13 including an insulator 12 and a wire conductor 11, the outer circumference of which is coated with the insulator 12, a magnetic-material layer 16 including a magnetic-material-containing member that is wound around the outer circumference of the insulated wire 13, a shield layer 18 with which the outer circumference of the magnetic-material layer 16 is coated, a magnetic-material-fixing-and-insulating tape layer 17 that is disposed between the magnetic-material layer 16 and the shield layer 18, and a sheath 19 that is an insulating protective layer made of, for example, resin. The magnetic-material-fixing-and-insulating tape layer 17 fixes the magnetic-material layer 16 and insulates the magnetic-material layer 16 and the shield layer 18 from each other.

The magnetic-material-fixing-and-insulating tape layer 17 of the noise reduction cable 20 can fix the magnetic-material layer 16 and insulate the magnetic-material layer 16 and the shield layer 18 from each other, as in the case of the magnetic-material-fixing-and-insulating tape layer 17 of the noise reduction cable 10 according to the first embodiment.

Effects of Embodiments

In the noise reduction cables 10 and 20 according to the embodiments, the magnetic-material layer 16 is disposed inside the shield layer 18, and the magnetic-material-fixing-and-insulating tape layer 17, which can fix the magnetic-material layer 16 and insulate the magnetic-material layer 16 and the shield layer 18 from each other, is disposed between the magnetic-material layer 16 and the shield layer 18. Accordingly, radiation noise can be suppressed, and the magnetic-material layer 16 can be prevented from being detached without increasing the number of components.

Although the embodiments of the present invention have been described above, the present invention is not limited to the above embodiments, and various modifications can be made without departing from the concept of the invention.

The above embodiments do not limit the invention recited in claims. It should be noted that all of the combinations of features described in the embodiments are not necessarily essential in achieving the object of the invention.

What is claimed is:

1. A noise reduction cable comprising:

an insulated wire including an insulator and a wire conductor, an outer circumference of which is coated with the insulator;

a magnetic-material layer including a magnetic-material-containing member wound around an outer circumference of the insulated wire;

a shield layer with which an outer circumference of the magnetic-material layer is coated;

a magnetic-material-fixing-and-insulating tape layer that is disposed between the magnetic-material layer and the shield layer, the magnetic-material-fixing-and-insulating tape layer fixing the magnetic-material layer and insulating the magnetic-material layer and the shield layer from each other; and a sheath comprising an insulating protective layer made of resin, and covering an outer circumference of the shield layer, wherein the shield layer is formed of braided strands.

2. The noise reduction cable according to claim 1, wherein the magnetic-material-containing member is made of a metallic magnetic material.

3. The noise reduction cable according to claim 1, wherein the magnetic-material layer includes the magnetic-material-containing member that is helically wound.

4. The noise reduction cable according to claim 1, wherein the magnetic-material layer includes the magnetic-material-containing member that is wound such that a longitudinal direction of the magnetic-material-containing member is parallel to an axis of the noise reduction cable.

5. The noise reduction cable according to claim 1, wherein the magnetic-material layer includes a plurality of magnetic-material-containing members that are arranged at intervals along an axis of the noise reduction cable.

6. The noise reduction cable according to claim 1, wherein the magnetic-material-containing member comprises a material selected from amorphous alloy, ferrite, Fe—Ni alloy, Fe—Si—Al alloy and Fe—Si alloy.

7. The noise reduction cable according to claim 1, wherein the insulated wire comprises a plurality of insulated wires.

8. The noise reduction cable according to claim 7, further comprising:

a plurality of interposed objects formed adjacent to the plurality of insulated wires; and a holding layer that is disposed around the plurality of insulated wires and the plurality of interposed objects.

9. The noise reduction cable according to claim 8, wherein the plurality of insulated wires and the plurality of interposed objects are alternately arranged around an inner surface of the holding layer.

10. The noise reduction cable according to claim 8, wherein the holding layer comprises a resin tape that is helically wound around the plurality of insulated wires and the plurality of interposed objects along an axis of the noise reduction cable.

11. The noise reduction cable according to claim 8, wherein the holding layer comprises one of such as polyethylene terephthalate (PET) resin and polypropylene resin.

12. The noise reduction cable according to claim 8, wherein the magnetic material layer is formed around an outer surface of the holding layer.

13. The noise reduction cable according to claim 1, wherein the magnetic-material-fixing-and-insulating tape layer comprises one of polyethylene (PE), polyethylene terephthalate (PET) and cellophane.

14. A noise reduction cable comprising:

a plurality of insulated wires;

a plurality of interposed objects formed adjacent to the plurality of insulated wires;

a holding layer disposed around the plurality of insulated wires and the plurality of interposed objects, and comprising a resin tape that is helically wound around the plurality of insulated wires and the plurality of interposed objects along an axis of the noise reduction cable;

a magnetic-material layer formed around an outer circumference of the holding layer, and comprising one of amorphous alloy, ferrite, Fe—Ni alloy, Fe—Si—Al alloy and Fe—Si alloy;

a shield layer formed around an outer circumference of the magnetic-material layer, and comprising a plurality of braided strands;

a magnetic-material-fixing-and-insulating tape layer that is disposed between the magnetic-material layer and the shield layer, the magnetic-material-fixing-and-insulating tape layer fixing the magnetic-material layer and insulating the magnetic-material layer and the shield layer from each other, and comprising one of polyethylene (PE), polyethylene terephthalate (PET) and cellophane; and a sheath comprising a resin and covering an outer circumference of the shield layer.

* * * * *